US009894939B1

(12) United States Patent
Sun

(10) Patent No.: US 9,894,939 B1
(45) Date of Patent: Feb. 20, 2018

(54) GARMENT INCLUDING SHAPEWEAR

(71) Applicant: PROJECT GRAVITAS, LLC, New York, NY (US)

(72) Inventor: Lisa L. Sun, New York, NY (US)

(73) Assignee: Peoject Gravitas, LLC, New York, NY (US)

( * ) Notice: Subject to any disclaimer, the term of this patent is extended or adjusted under 35 U.S.C. 154(b) by 0 days.

(21) Appl. No.: 15/296,906

(22) Filed: Oct. 18, 2016

(51) Int. Cl.

| | |
|---|---|
| ***A41C 1/00*** | (2006.01) |
| ***A41D 1/22*** | (2018.01) |
| ***A41D 1/06*** | (2006.01) |
| ***A41D 27/20*** | (2006.01) |

(52) U.S. Cl.
CPC ..... *A41C 1/003* (2013.01); *A41D 1/06* (2013.01); *A41D 1/22* (2013.01); *A41D 27/20* (2013.01); *A41D 2300/322* (2013.01); *A41D 2400/38* (2013.01)

(58) Field of Classification Search
CPC ... A41D 1/06; A41D 1/08; A41D 1/14; A41D 1/13; A41D 1/1245; A41C 1/00; A41C 1/02; A41C 3/06
USPC ..... 2/227, 236, 237, 74, 69, 228; 450/94–97
See application file for complete search history.

(56) References Cited

U.S. PATENT DOCUMENTS

| | | | | |
|---|---|---|---|---|
| 4,069,513 A * | 1/1978 | Shiller | ..... | A41D 1/14 2/212 |
| 2012/0129425 A1* | 5/2012 | Bevans | ..... | A41D 1/06 450/11 |

* cited by examiner

*Primary Examiner* — Gloria Hale
(74) *Attorney, Agent, or Firm* — Drinker Biddle & Reath LLP

(57) ABSTRACT

A garment includes an exterior garment having a waist portion, a first leg portion, and a second leg portion. An inner lining is attached to the exterior garment at the waist portion, the inner lining including a first leg portion disposed within the first leg portion of the exterior garment, and a second leg portion disposed within the second leg portion of the exterior garment. The inner lining includes a shaping material.

3 Claims, 20 Drawing Sheets

GARMENT INCLUDING SHAPEWEAR

FIELD OF THE INVENTION

The present invention relates generally to clothing that includes shaping material. Exterior garments, such as dresses and pants, are provided with a material that conforms to the wearer's body. The exterior garment and shaping material are formed together as a single garment. The invention also relates generally to a method of creating an exterior garment provided with a shaping material formed together as a single garment.

BACKGROUND OF THE INVENTION

For years, women have been searching to dress in a way that solves multiple challenges: a polished and refined professional look with lasting quality, and a silhouette that smooths, shapes, and contours their best features. Today, most women would need to buy separate pieces of clothing to accomplish this—an exterior garment such as a dress or pants and undergarments that provide shaping and control (i.e., control top hosiery, compression shape wear).

This can cause some dissatisfaction. For example, shaping undergarments are not designed specifically with an exterior garment in mind. Thus, the silhouettes and fabrics may compete. In some cases, the shaping undergarment may show through or be visible on the exterior garment.

In addition, shaping undergarments have a tendency to not stay in place on the body, resulting in, for example, rolling or tucking of the undergarment. The undergarments tend to move throughout the day with the movements of the wearer. The undesirable movement of the shaping undergarment could be more pronounced, for example, when putting on an exterior garment over the shaping undergarments.

Shaping undergarments may cause discomfort if worn for long periods during the day. The undergarments tend to be tight, in part, to avoid undesirable movement of the undergarment and to lower the likelihood that the undergarment will either compete with or be visible through the exterior garment.

Furthermore, wearing separate exterior garments and shaping undergarments is inconvenient. Of course, the necessity of wearing two garments in itself is inconvenient. In addition, because the undergarments and exterior garments are worn separately, the undergarment can show through the external garment, thereby requiring the purchase of additional shaping undergarments to avoid the undergarment competing with the exterior garment.

An object of the invention is to provide clothing that includes shaping material to address problems described above.

SUMMARY OF THE INVENTION

In an embodiment, the invention provides a garment including an exterior garment having a waist portion, a first leg portion, and a second leg portion. An inner lining is attached to the exterior garment at the waist portion, the inner lining including a first leg portion disposed within the first leg portion of the exterior garment, and a second leg portion disposed within the second leg portion of the exterior garment. The inner lining includes a shaping material.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain features of the invention.

DETAILED DESCRIPTION OF THE PREFERRED EMBODIMENTS

Figure 1:
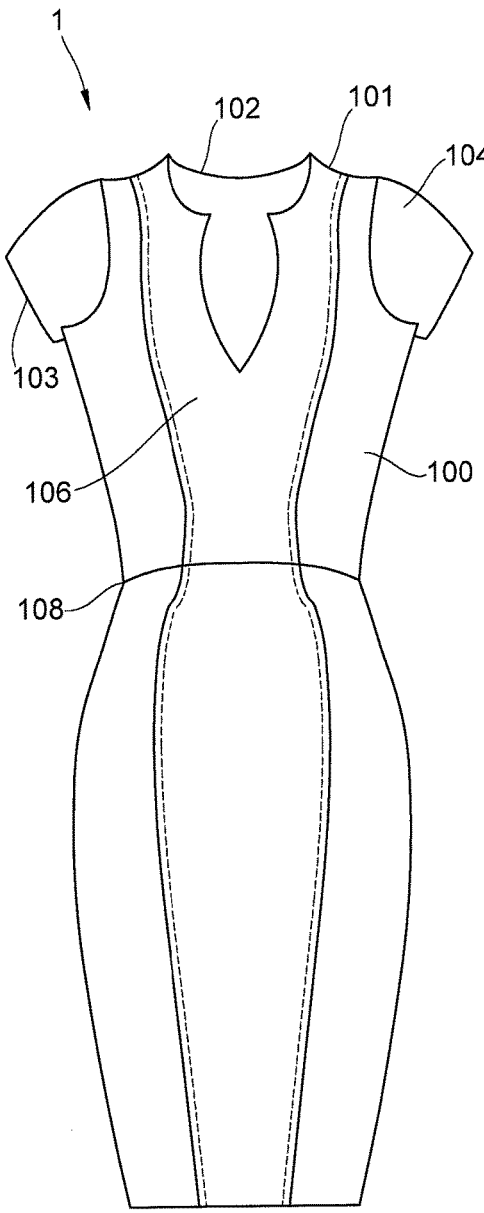
FIG. 1 is a front view of a dress according to a first embodiment.
Figure 2:
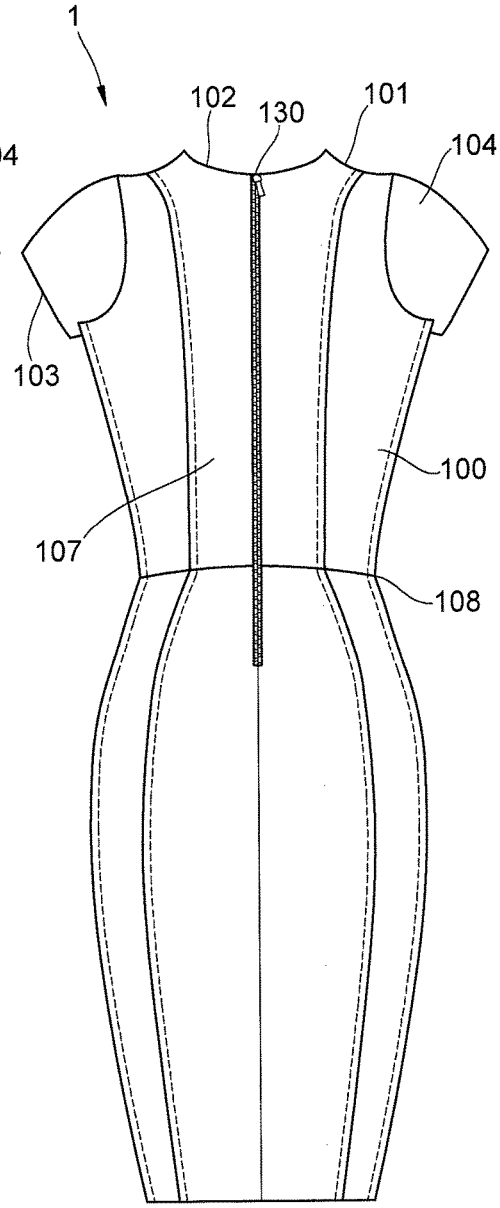
FIG. 2 is a rear view of the dress shown in FIG. 1.
Figure 3:
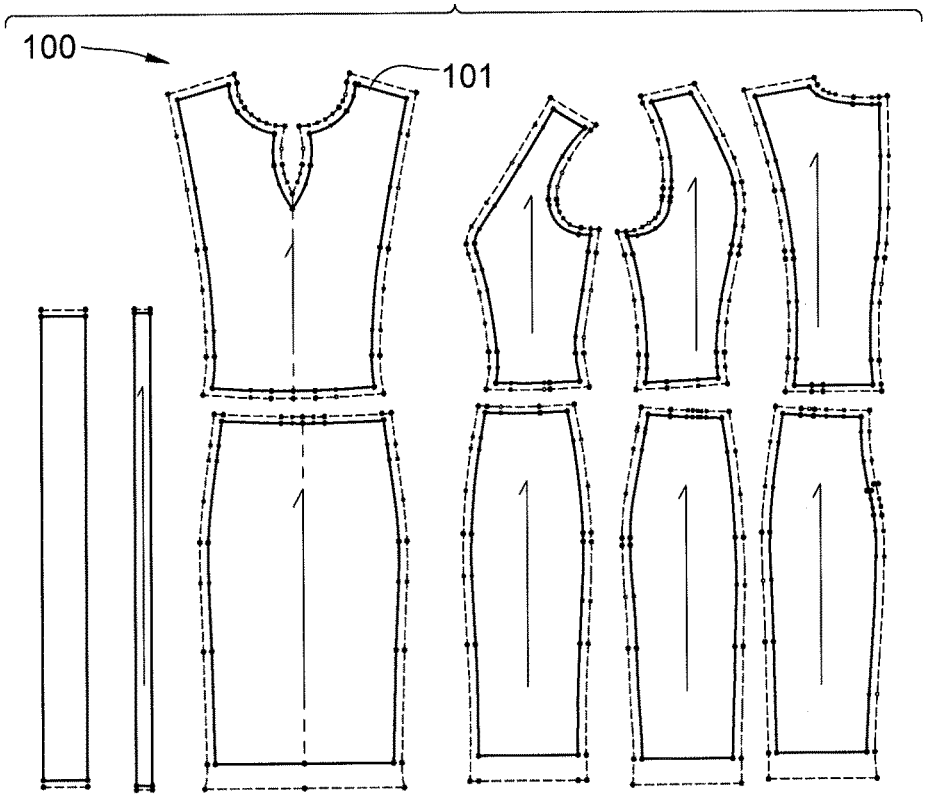
FIG. 3 is a pattern of the exterior of the dress shown in FIG. 1.
Figure 4:
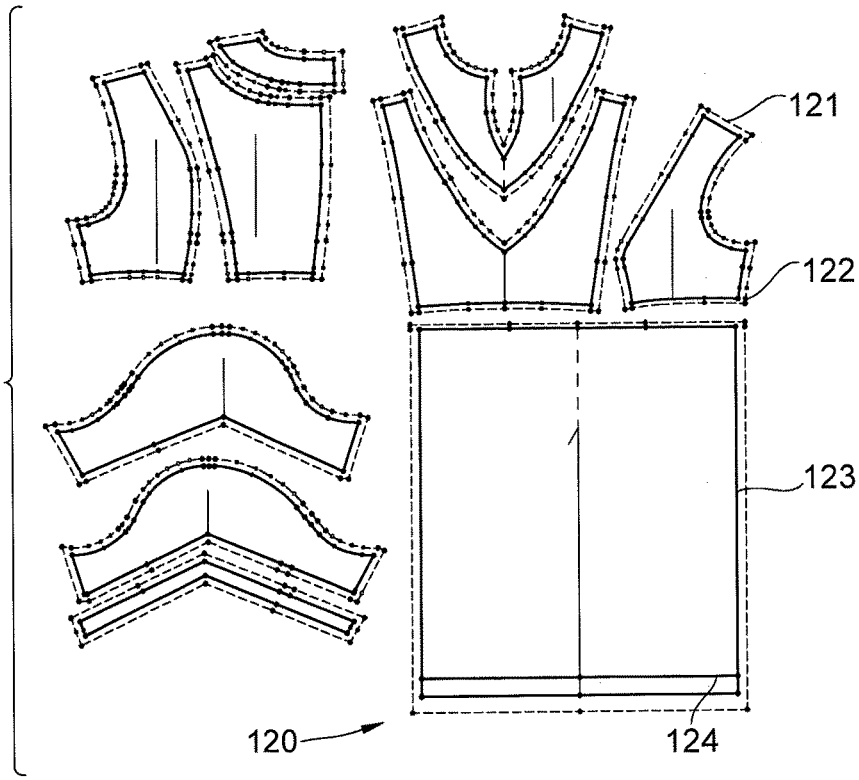
FIG. 4 is a pattern of the shapewear interior and sleeves of the dress shown in FIG. 1.
Figure 5:
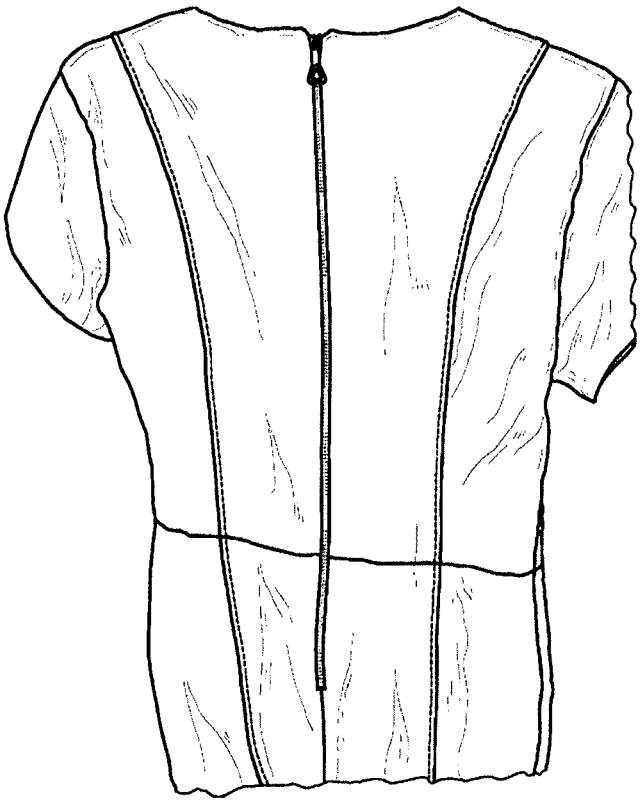
FIG. 5 is a detail of a rear view of the dress shown in FIG. 1.
Figure 6:
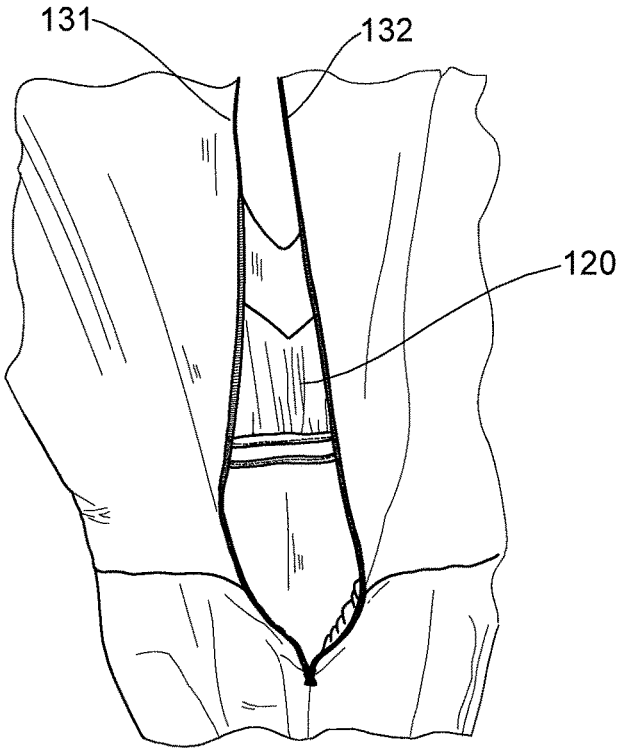
FIG. 6 is a detail of the dress shown in FIG. 1 with the zipper opened.

According to various embodiments, dresses are designed and manufactured to combine into one single garment the benefits of a professional, elegant exterior dress with the shaping/control attributes of shape wear. The dresses are manufactured with a set of features, including: a classic and professional exterior dress; made of the finest luxury stretch fabrics (including, for example, Italian fabrics) and luxury trim (e.g., RiRi zippers); double-stich seams that shape and contour the body visually while providing lasting quality and ensuring strength in the garment; shapewear lining built in and attached into the dress; linings have been designed specifically for each dress to create the ideal silhouette and flatter/highlight the best features of every woman's body; elastic waistband and silicon lace trim at the hem that hold the shapewear lining in place all day and prevents rolling and tucking; fabric that breathes and wicks for all-day comfort; shapewear fabric works with the exterior dress fabric so that the dress moves as a single garment with the lining sitting perfectly within the garment (e.g., no twisting, invisible from the outside, fabrics do not compete with each other); non-compression comfortable bust above the elastic waist band that is silky and feels good against the skin, while providing a way for the shapewear lining to be attached into the dress in a way that holds the shapewear in place and making it undetectable from the outside.

According to a first embodiment, for example as shown in FIGS. 1-10, a dress 1 is provided with an inner lining 120 and an exterior garment 100. The inner lining 120 includes a shaping non-compression bust fabric 121 that is attached to the facing at the top 101 of the exterior garment 100 around the neckline 102 and at the armholes 103 of the sleeves 104. The shaping non-compression bust fabric 121 extends down to below the bust 106 and is then attached to an elastic waistband 122 that sits directly below the bust 106 (typically below the underwire of a woman's bra). The elastic waistband 122 keeps the inner lining 120 in place, prevents twisting of the inner lining 120, and remains invisible from the outside. From the elastic waistband 122, a shapewear skirt 123 with an hourglass silhouette is attached. The shapewear skirt 123 is tight around the waist and main torso of the wearer, is wider at the hip to provide contouring around the hips and buttocks, then tapers into a straight skirt to shape the thigh area with a wider sweep at the hem to allow for easy walking. Each dress with this construction may have a slightly different silhouette tailored to the shape of the dress (e.g., some are shorter, some are more hourglass vs. straight column). At the bottom 124 of the shapewear lining 120 is a lace trim 125 that on the interior has a silicon grip to hold the bottom 124 of the lining 120 in place against the leg and to prevent the lining 120 from rolling up. The lace trim 125 also keeps the inner lining 120 discreet, giving the appearance of lingerie rather than shapewear.

Figure 7:
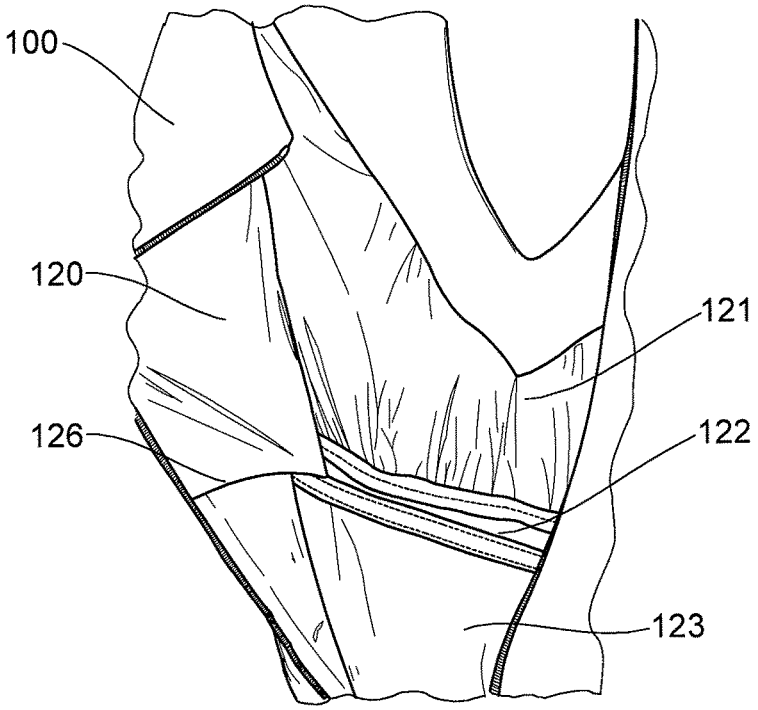
FIG. 7 is a detail of the dress shown in FIG. 1 with the zipper opened.
Figure 8:
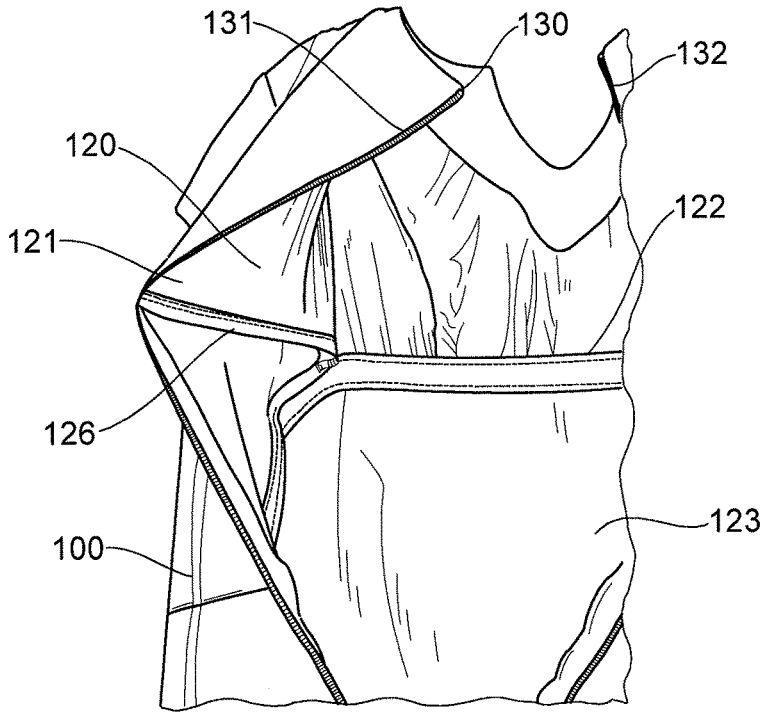
FIG. 8 is a detail of the dress shown in FIG. 1 with the zipper opened.
Figure 9:
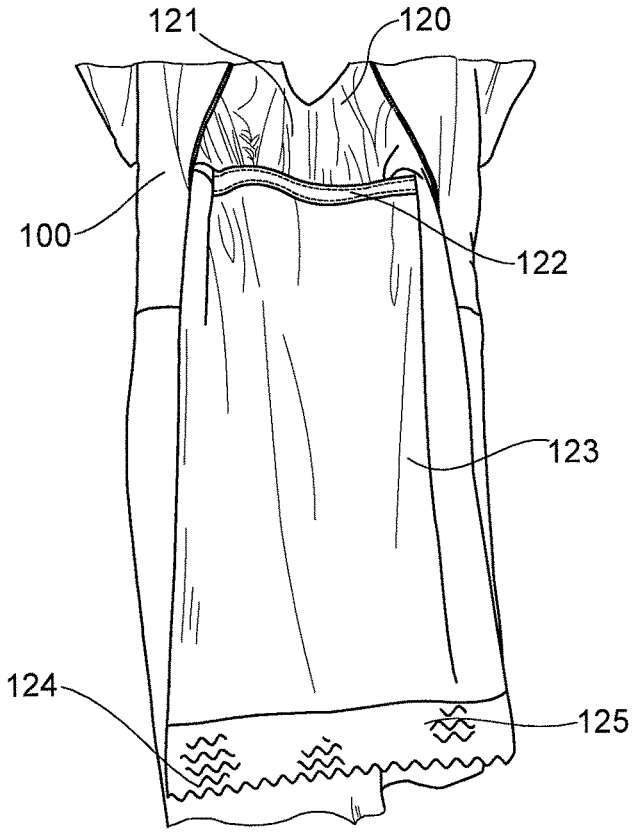
FIG. 9 is a detail of the dress shown in FIG. 1 with the shapewear pulled out.

The dress 1 may be provided with a zipper 130 at the back 107 of the exterior garment 100 of the dress 1. The zipper 130 may be on the back 107 of the dress 1 and positioned in the middle of the dress 1 from below the waist 108 to the neckline 102. The inner lining 120 and the exterior garment 100 are sewn together on a first side 131 and a second side 132 of the zipper 130, such that the shaping non-compression bust fabric 121 forms an opening 126 in the inner lining 120 when the zipper 130 is opened. In this regard, as shown in FIGS. 7 and 8, the shaping non-compression bust fabric 121 is not sewn to the entire periphery of the elastic waistband 122 to create the opening 126. To get into the dress 1, a woman unzips the zipper 130 on the back 107 of the dress 1, steps into the inner lining 120, pulls the elastic waistband 122 up her body so that it sits below her bust 106 (typically below the bra underwire), and then zips the dress 1 up.

For the construction of the inner lining 120, at least two different fabrics are used. The non-compression bust fabric 121 is formed from a material providing a silky lining that comfortably expands to accommodate all chest sizes. The non-compression bust fabric 121 does not press down on the wearer's bust if the wearer is larger and conforms if the wearer has a smaller bust. Preferably, the non-compression bust fabric 121 is comprised of a blend of 77% nylon and 23% elastane. The shapewear skirt 123 is a stronger lining for smoothing/compression/control. Preferably, the shapewear skirt 123 is comprised of a blend of 56% nylon and 44% elastane.

Combining the different materials into a single inner lining 120 presents a challenge at least because each material has a different stretch content and materials having a different stretch content could twist and/or bunch when combined. Testing of various fabric combinations yields a satisfactory combination of materials.

Figure 10A:
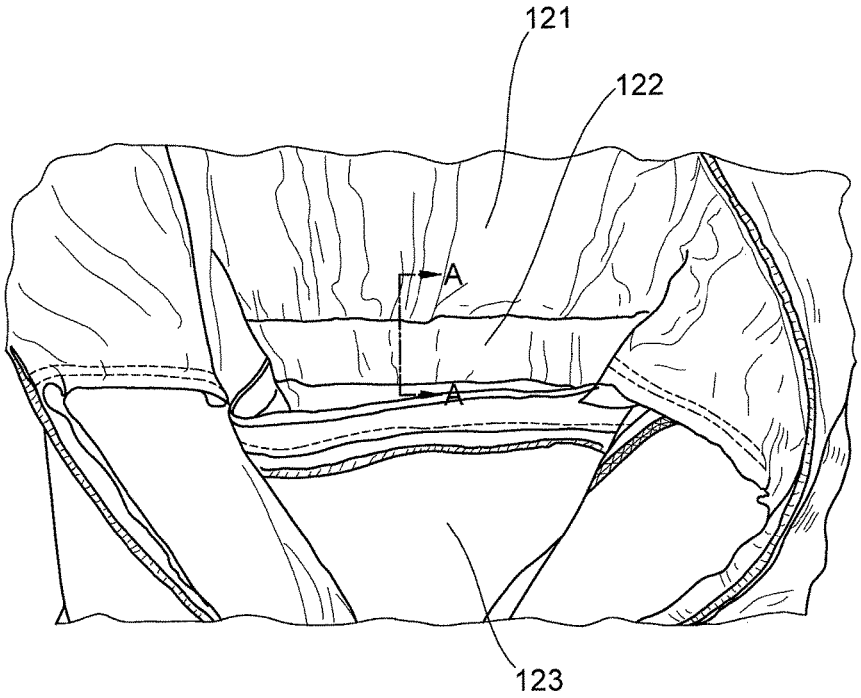
FIG. 10*a* is a detail of the inside of the dress shown in FIG. 1.
Figure 10B:
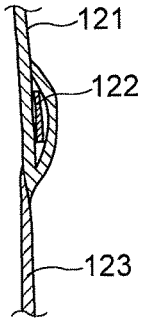
FIG. 10*b* is a cross-sectional view of the inner lining along line A-A of FIG. 10*a;*
Figure 11:
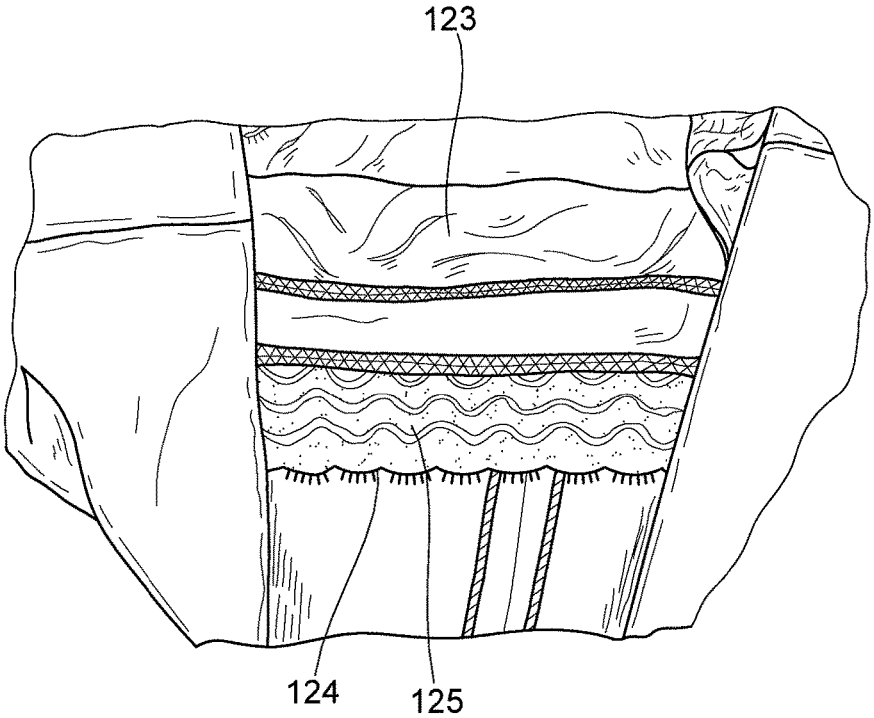
FIG. 11 is a detail of the hem of the shapewear.
Figure 12:
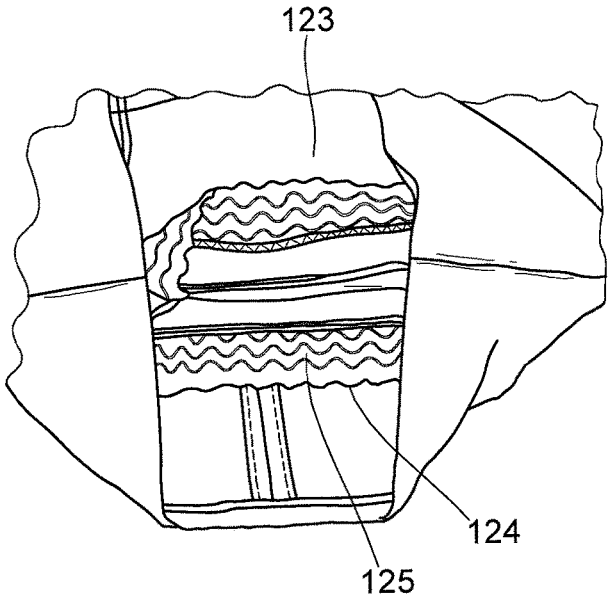
FIG. 12 is a detail of the hem of the shapewear.
Figure 13:
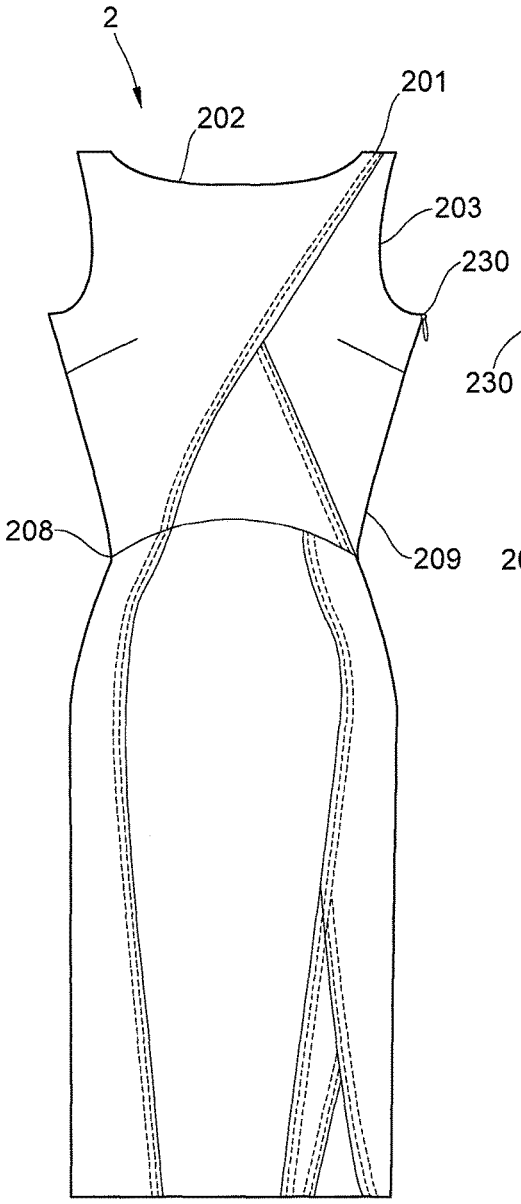
FIG. 13 is a front view of a dress according to a second embodiment.
Figure 14:
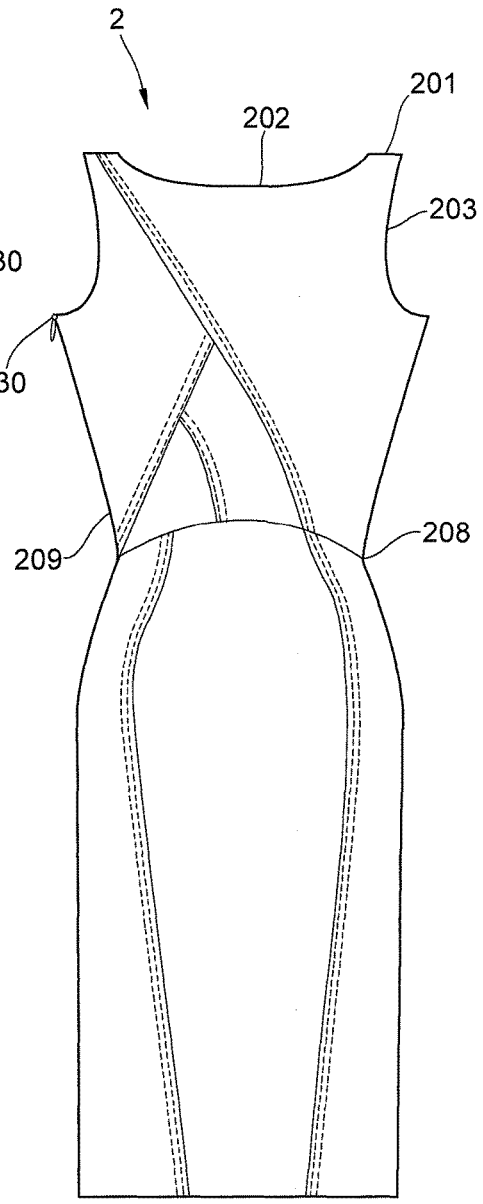
FIG. 14 is a rear view of the dress shown in FIG. 13.
Figure 15:
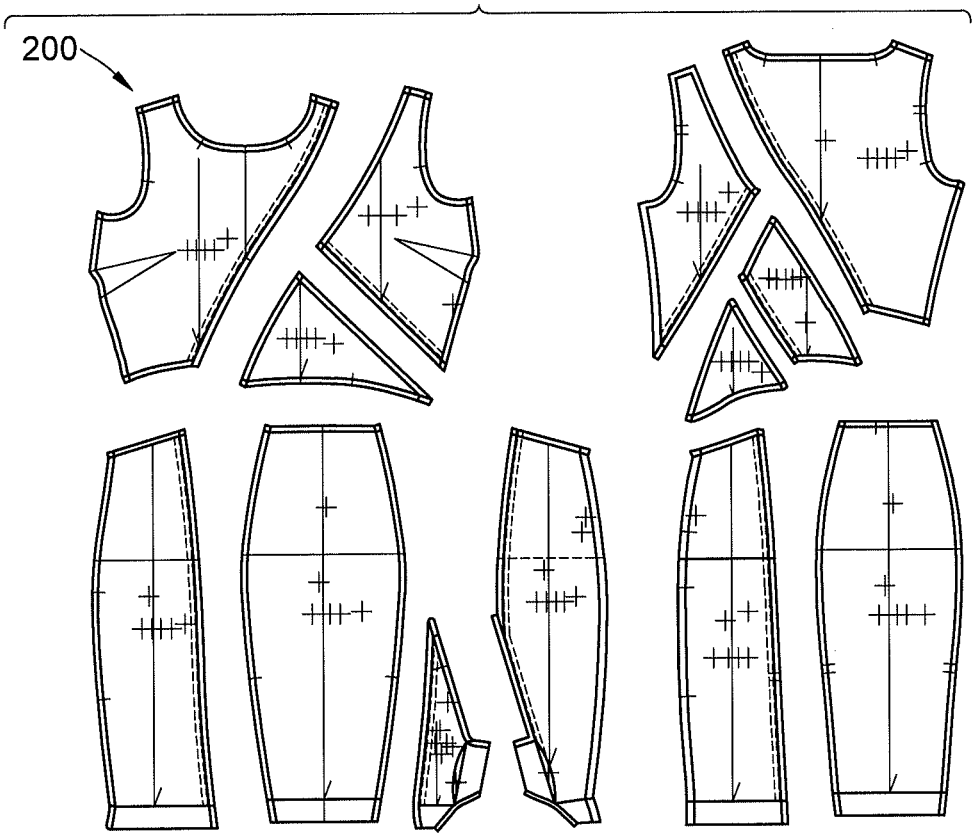
FIG. 15 is a pattern of the exterior of the dress shown in FIG. 13
Figure 16:
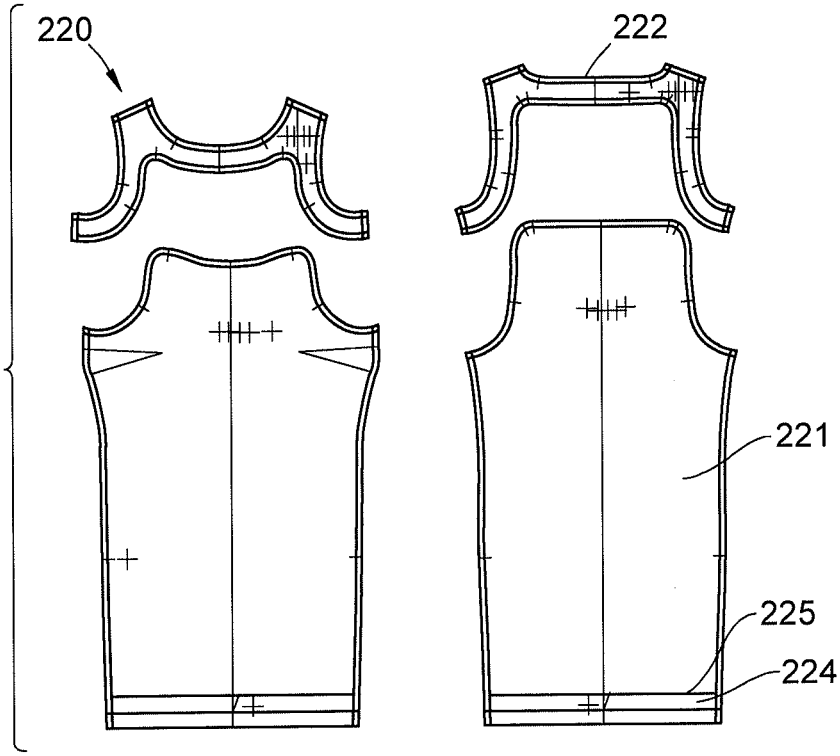
FIG. 16 is a pattern of the shapewear interior of the dress shown in FIG. 13.

As shown in FIG. 10*b*, the two fabrics of the inner lining 120 are held together with the support elastic waistband 122. The non-compression bust fabric 121 is looped over the elastic waistband 122 such that the elastic waistband 122 is covered all around with the non-compression bust fabric 121 of the inner lining 120. The non-compression bust fabric 121 may be moisture-wicking to provide added comfort for the wearer. When viewed from the inside of the dress 1, the elastic waistband 122 is hidden from view in the inner lining 120. Thus, the elastic waistband 122 does not sit directly against the wearer's skin. Instead, a moisture-wicking non-compression bust fabric 121 sits against the skin comfortably.

The dress 1 is preferably provided with a facing on the inside of the exterior garment 100. A fabric is applied around the neckline 102 and armholes 103 on the inside of the exterior garment 100. The shapewear inner lining 120 is then attached to the facing. This construction additionally prevents the inner lining 120 from twisting and competing with the fabric of the exterior garment 100, thereby keeping everything laying flat.

According to a second embodiment, for example as shown in FIGS. 13-17, referred to as a column construction, a dress 2 is provided with an inner lining 220 and an exterior garment 200. The inner lining 220 is a single material of shapewear lining 221. The inner lining 220 is attached at the neckline 202 facing of the exterior garment 200 and to the shoulders on the top 201 of the exterior garment 200 and around the armholes 203 of the exterior garment 200. The inner lining 220 may include an attachment portion 222 by which the inner lining 220 is attached to the facing of the exterior garment 200. According to the second embodiment, the dress 2 does not include an elastic waistband or non-compression shaping bust fabric. At the bottom 224 of each shapewear lining 220 is a lace trim 225. On the interior of the lace trim 225 is a silicon grip to hold the bottom of the inner lining 220 in place against the leg and to prevent the inner lining 220 from rolling up. The lace trim 225 also keeps the inner lining 220 discreet, giving the appearance of lingerie rather than shapewear.

Figure 17:
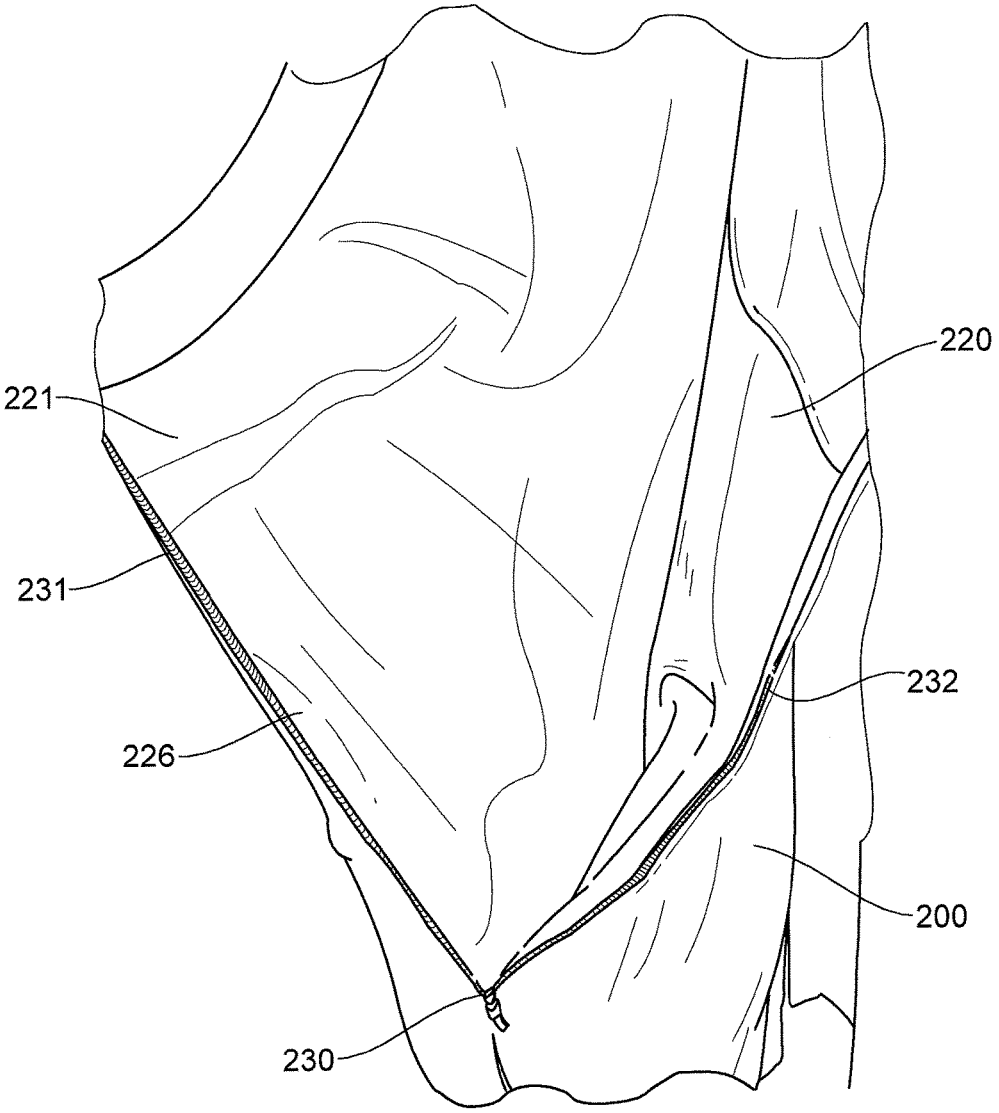
FIG. 17 a detail of the dress shown in FIG. 13 with the zipper open showing the shapewear interior.
Figure 18:
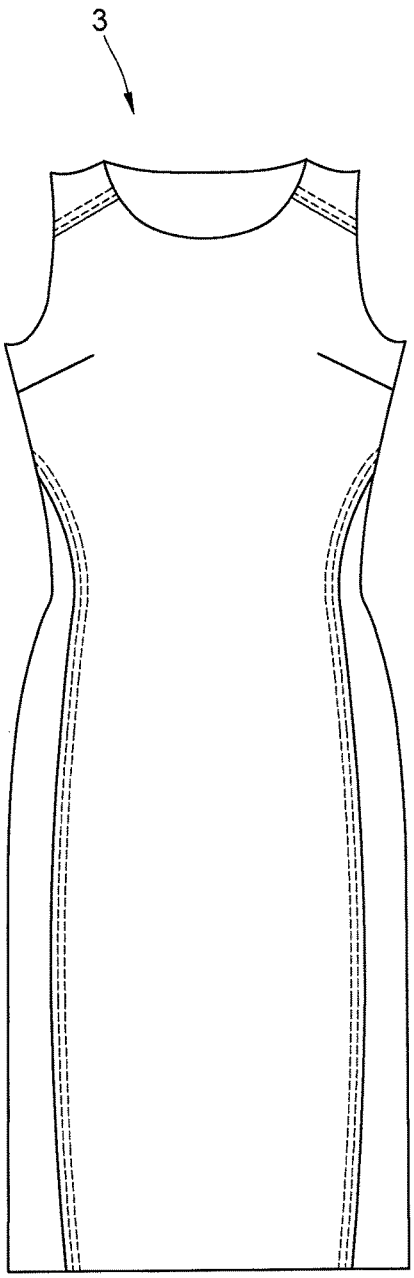
FIG. 18 is a front view of a dress according to another embodiment.
Figure 19:
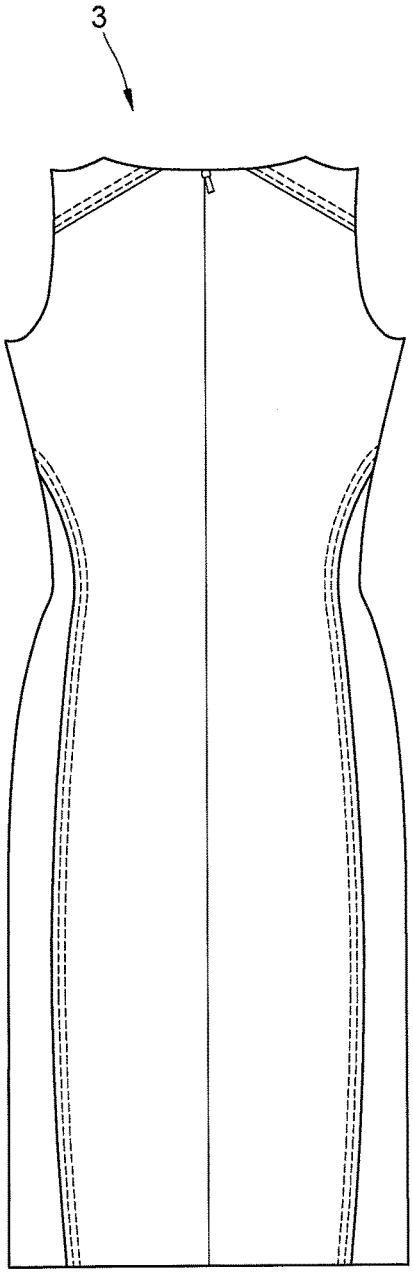
FIG. 19 is a rear view of the dress shown in FIG. 18.
Figure 20:
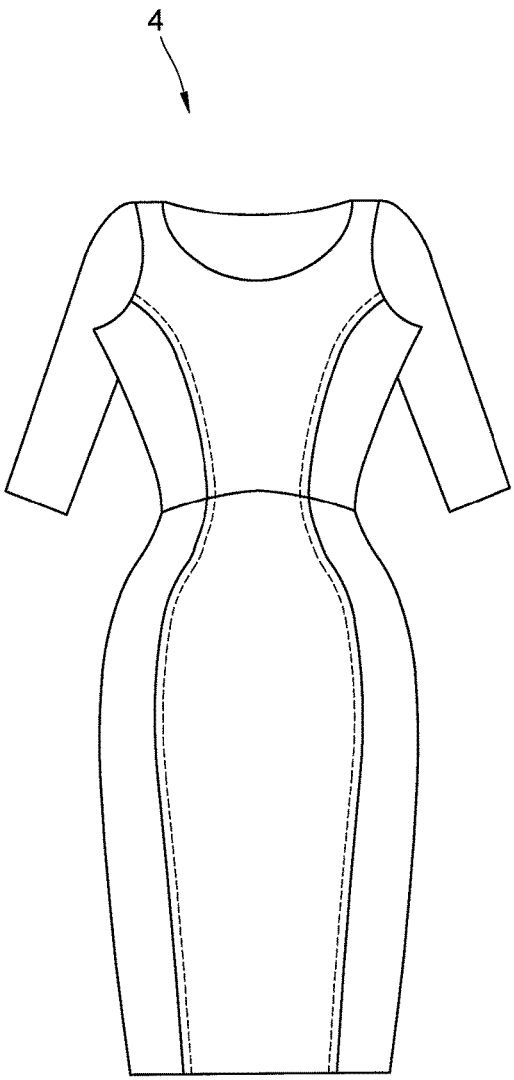
FIG. 20 is a front view of a dress according to another embodiment.
Figure 21:
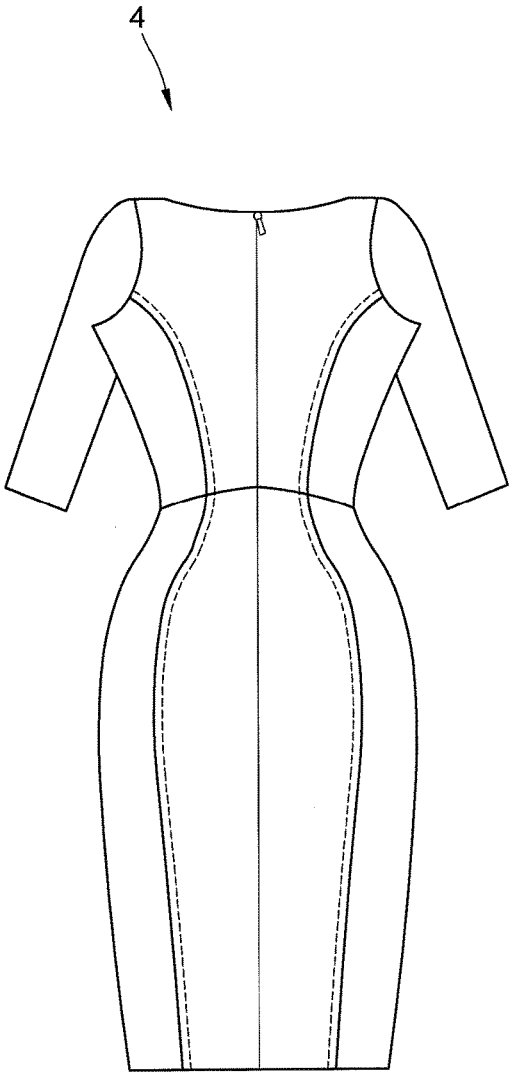
FIG. 21 is a rear view of the dress shown in FIG. 20.
Figure 22:
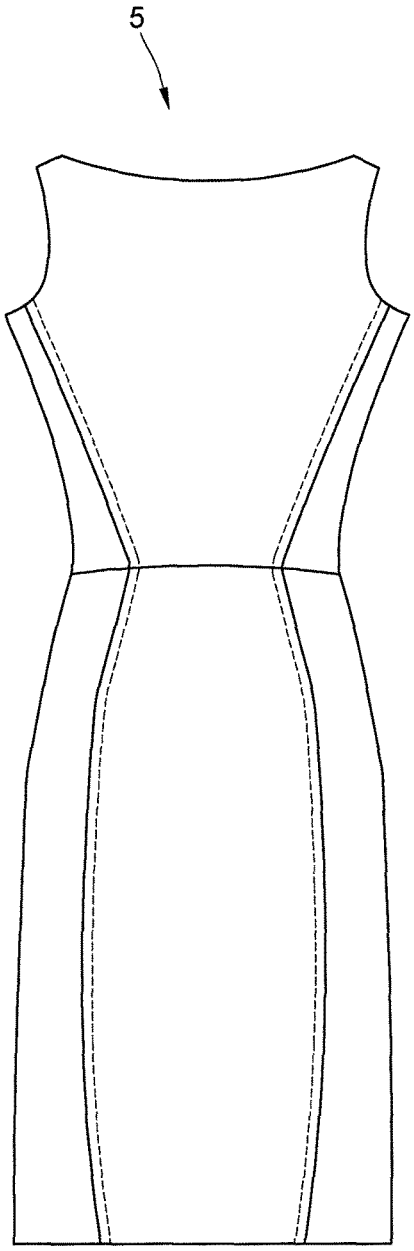
FIG. 22 is a front view of a dress according to another embodiment.
Figure 23:
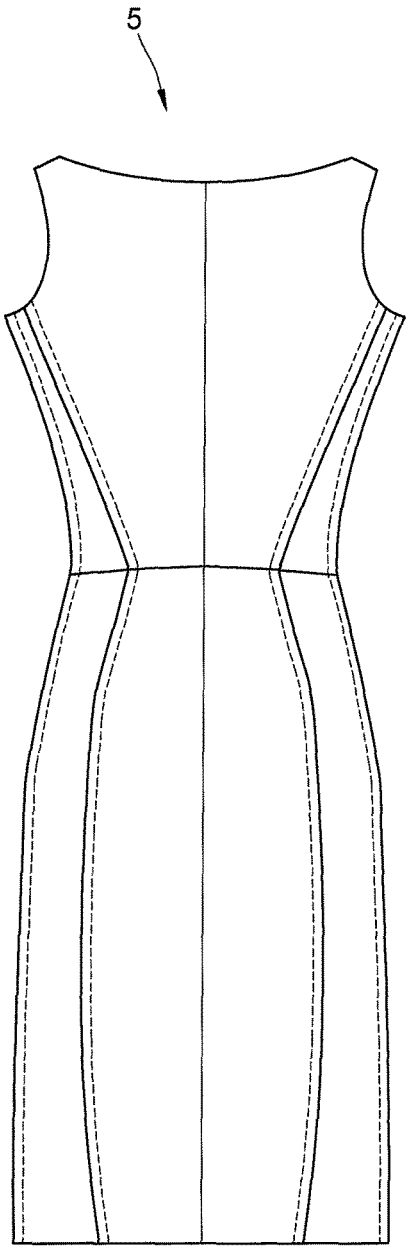
FIG. 23 is a rear view of the dress shown in FIG. 22.
Figure 24:
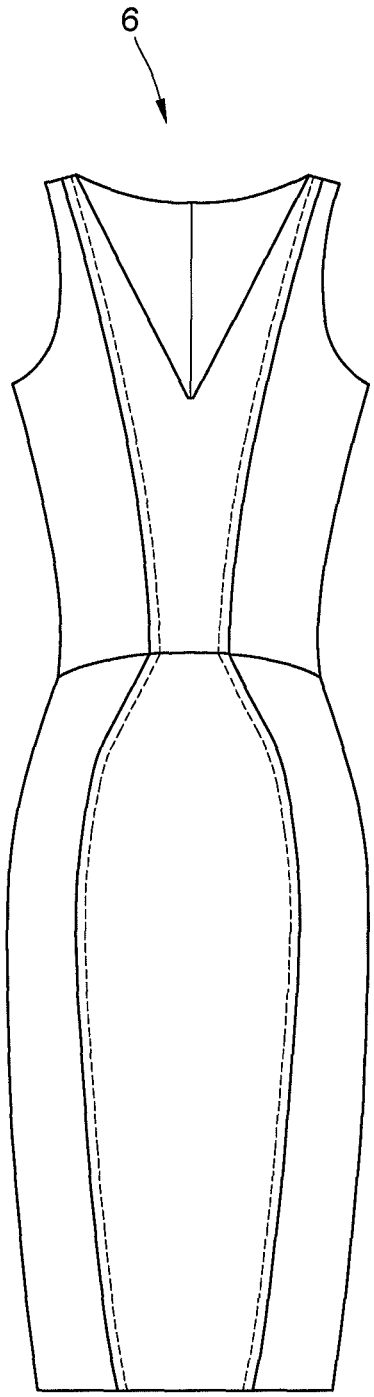
FIG. 24 is a front view of a dress according to another embodiment.
Figure 25:
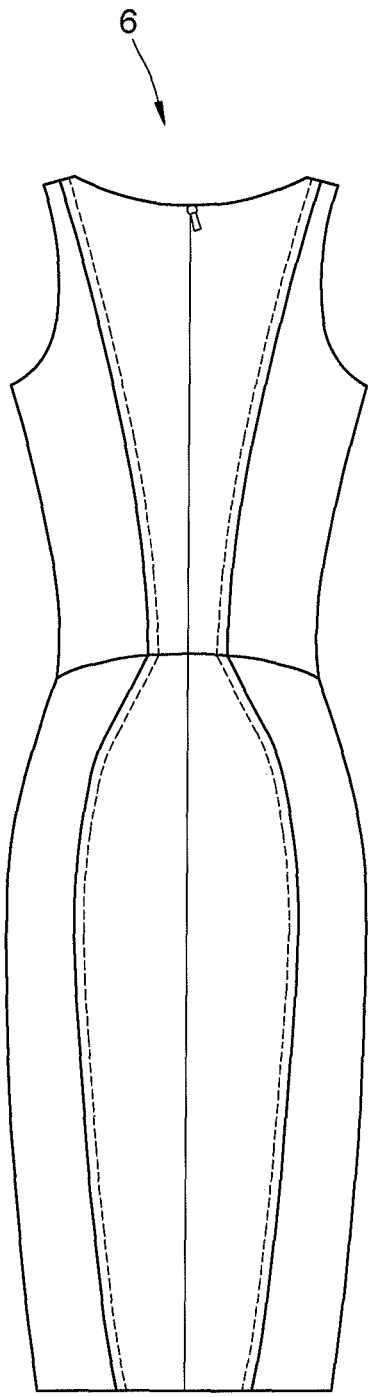
FIG. 25 is a rear view of the dress shown in FIG. 24.
Figure 26:
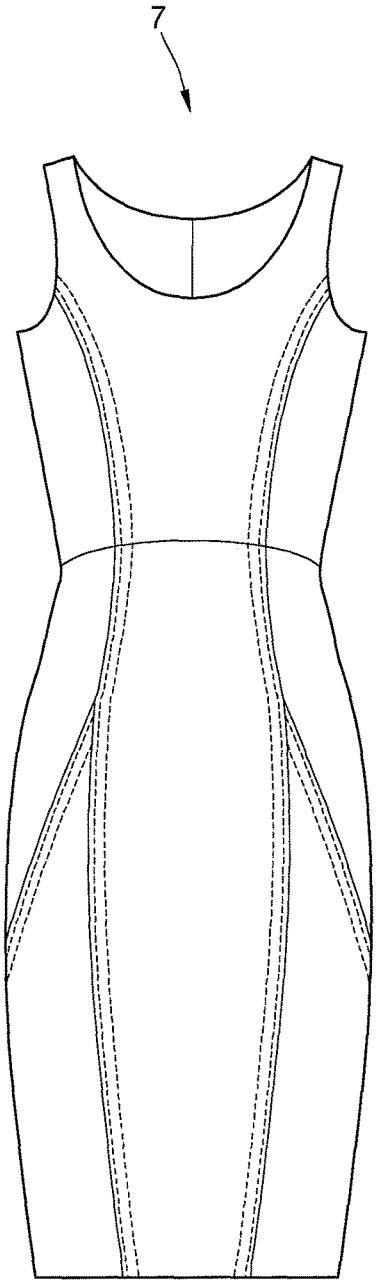
FIG. 26 is a front view of a dress according to another embodiment.
Figure 27:
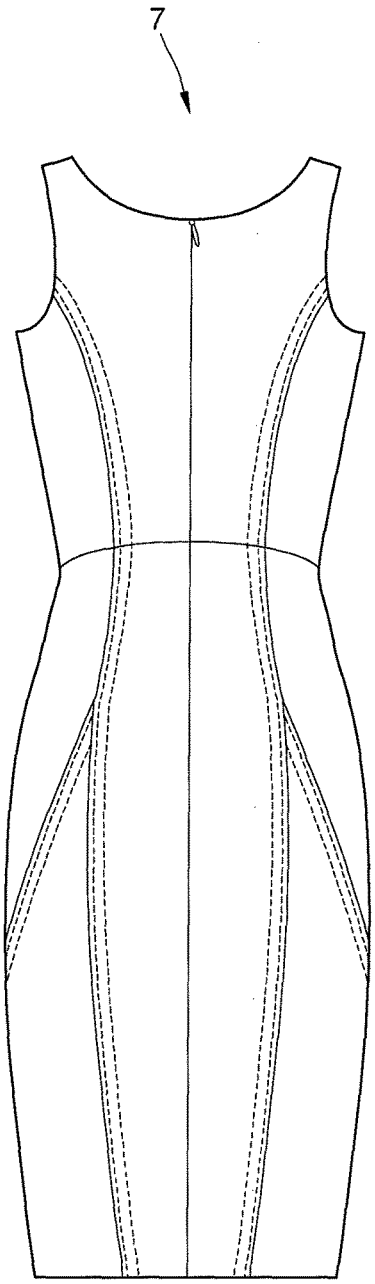
FIG. 27 is a rear view of the dress shown in FIG. 26.
Figure 28:
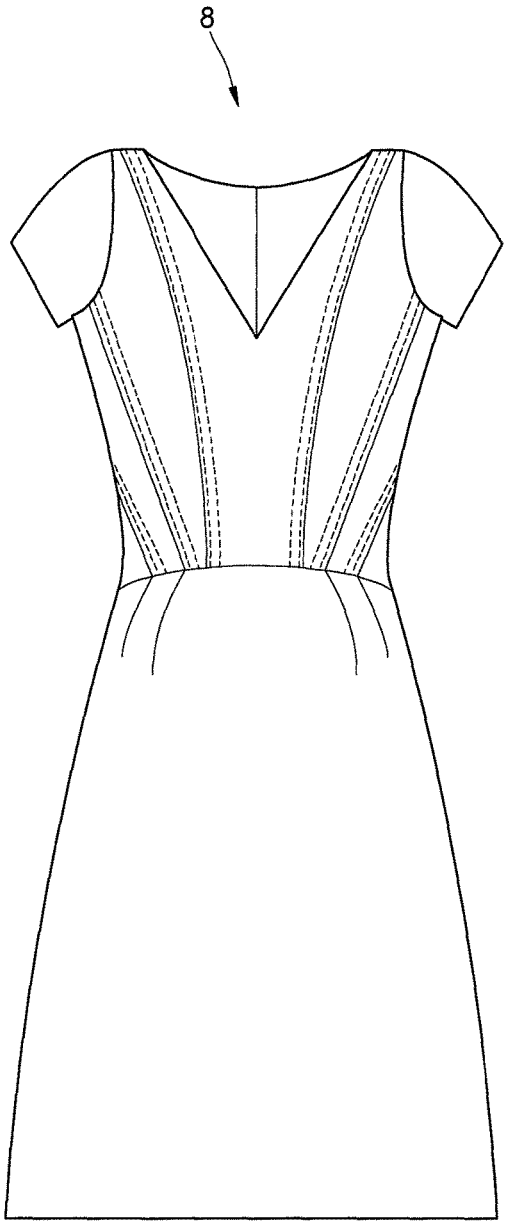
FIG. 28 is a front view of a dress according to another embodiment.
Figure 29:
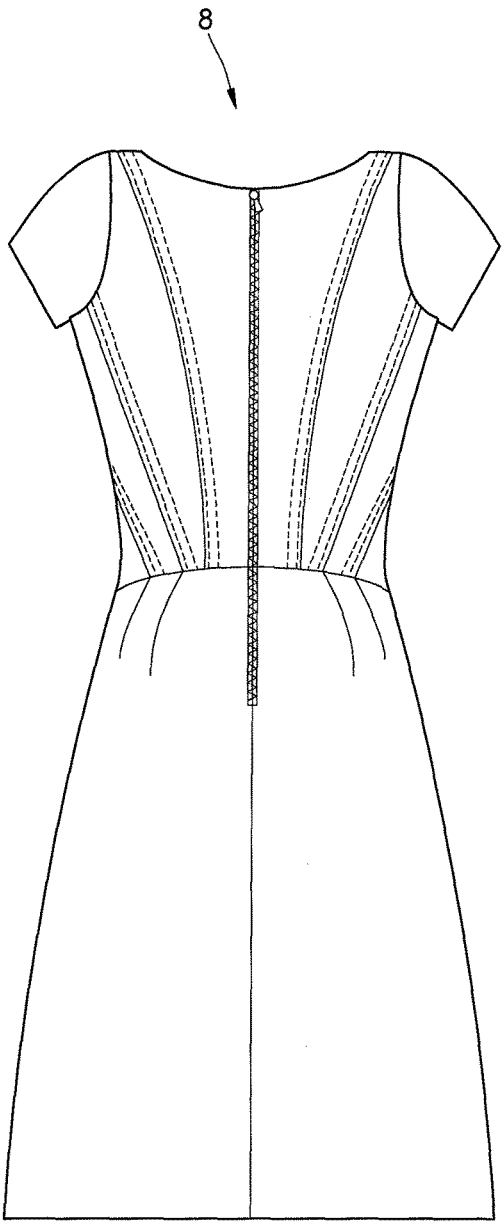
FIG. 29 is a rear view of the dress shown in FIG. 28.
Figure 30:
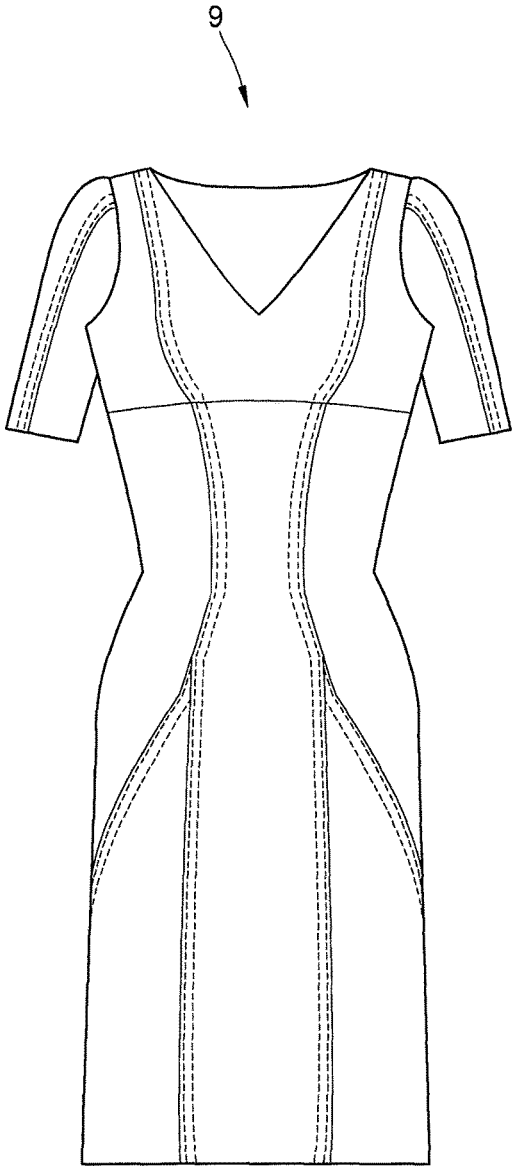
FIG. 30 is a front view of a dress according to another embodiment.
Figure 31:
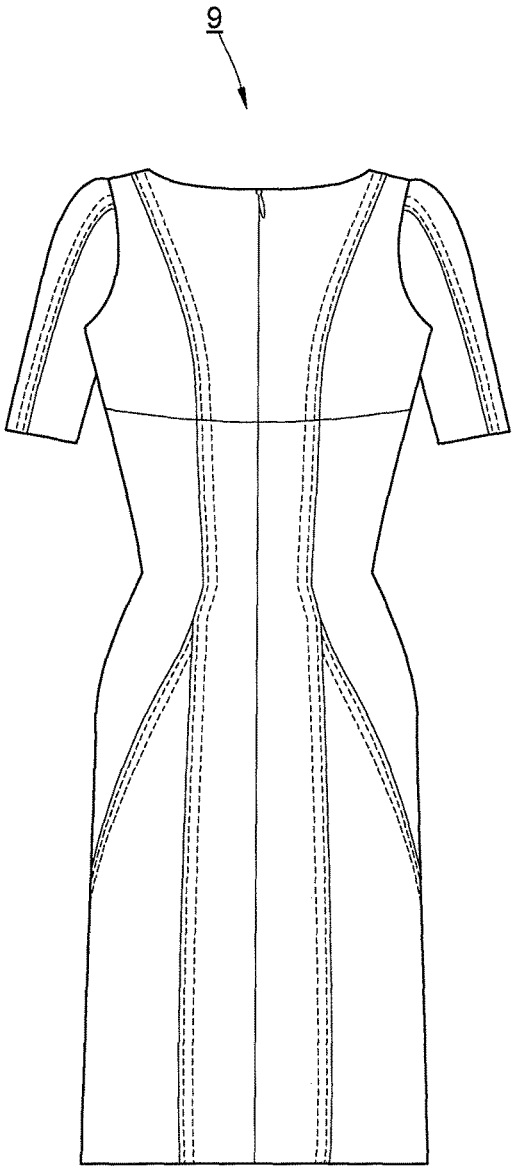
FIG. 31 is a rear view of the dress shown in FIG. 30.
Figure 32:
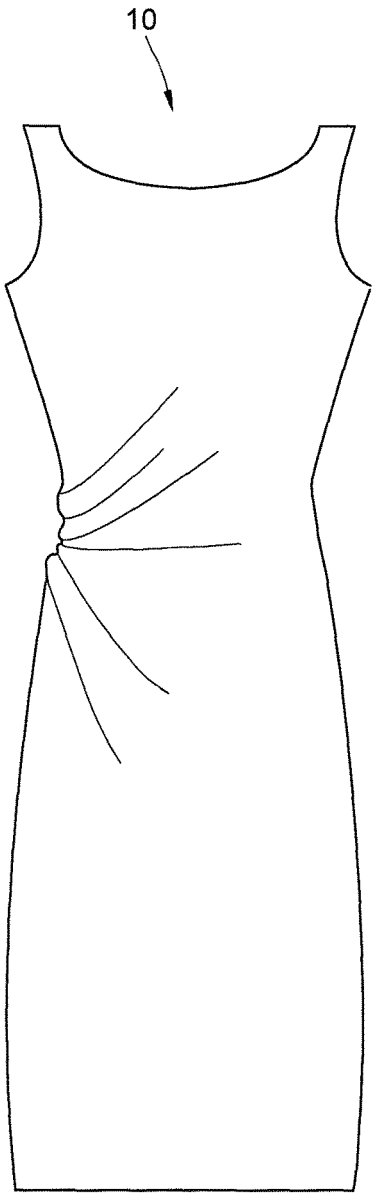
FIG. 32 is a front view of a dress according to another embodiment.
Figure 33:
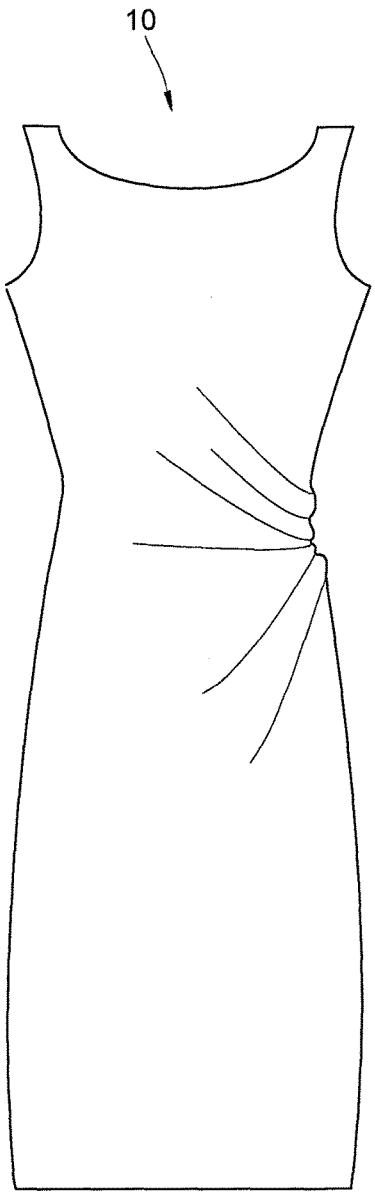
FIG. 33 is a rear view of the dress shown in FIG. 32.

The dress 2 is provided with a zipper 230 on a side 209 of the dress 2 in a side-zip construction, extending from one of the armholes 203 to the waist 208. As shown in FIG. 17, the inner lining 220 and the exterior garment 200 are sewn together on a first side 231 and a second side 232 of the zipper 230, such that the inner lining 220 forms an opening 226 in the inner lining 220 when the zipper 230 is opened. To get into the dress 2, a women unzips the side zipper 230 on the side 209 of the dress 2, pulls the dress 2 over her body by going in through the bottom of the dress 2 and pulling the dress 2 over her, then zips the dress 2 up.

The dress 2 is preferably provided with a facing on the inside of the exterior garment 200. A fabric is applied around the neckline 202 and armholes 203 on the inside of the exterior garment 200. The shapewear inner lining 220 is then attached to the facing. This construction additionally prevents the inner lining 220 from twisting and competing with the fabric of the exterior garment 200, thereby keeping everything laying flat.

Additional embodiments are shown in FIGS. 18-33. The inner lining of each additional embodiment could be constructed as a single fabric and attached at the top of the exterior garment. In the alternative, the inner lining of the additional embodiments could be constructed of a non-compression bust fabric and a shapewear skirt attached to each other at an elastic waistband.

Figure 34:
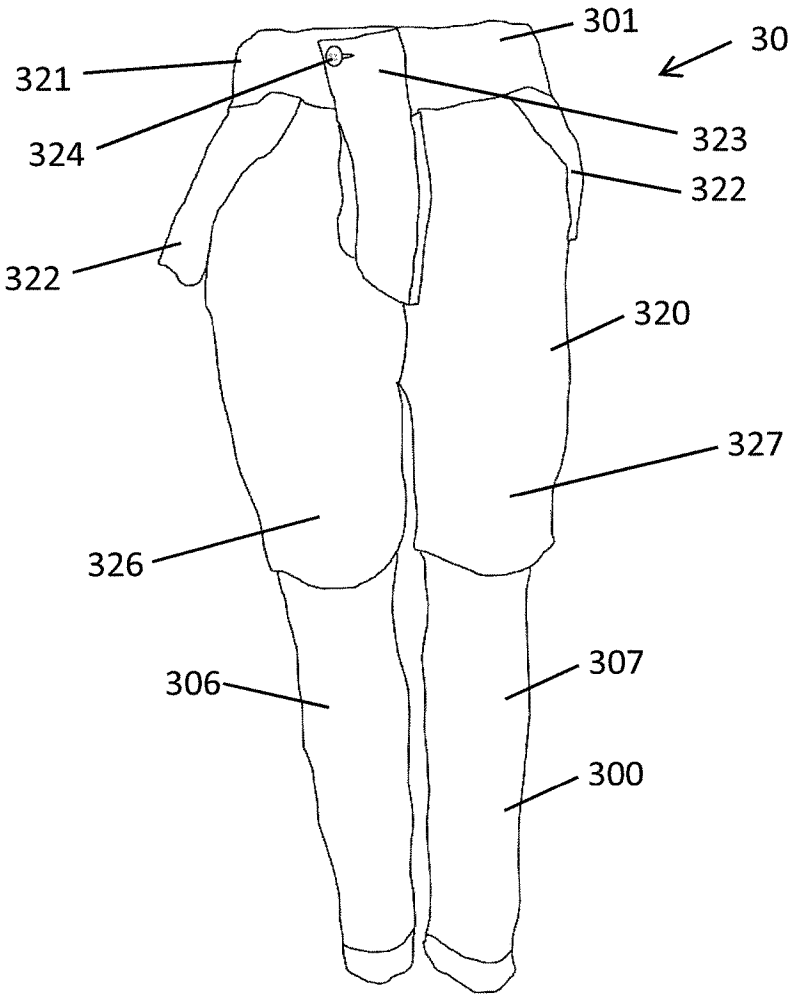
FIG. 34 is a front view of pants incorporating shapewear according to an embodiment.
Figure 35:
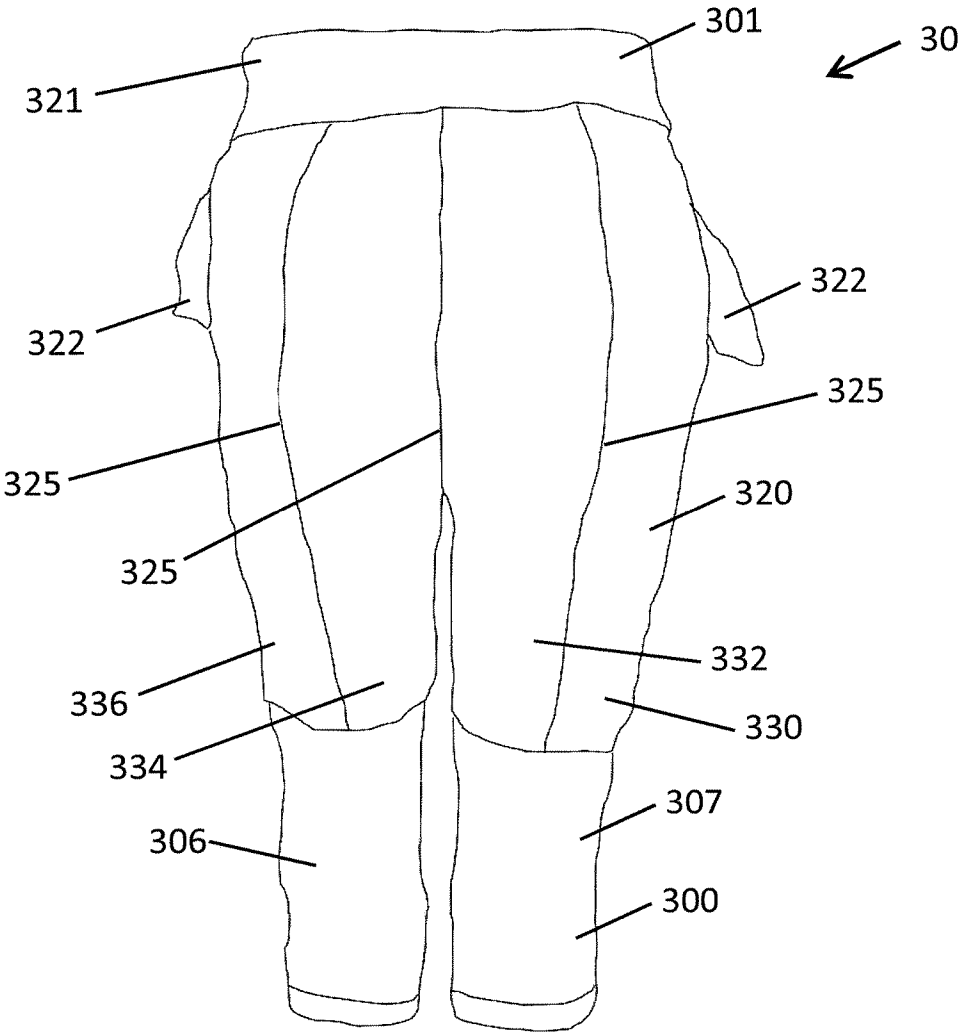
FIG. 35 is a rear view of the pants shown in FIG. 34.

According to another embodiment as shown in FIGS. 34 and 35, pants 30 can be constructed of an exterior garment 300 and an inner lining 320. The pants 30 are shown in an inside-out orientation in FIGS. 34 and 35. Inner lining 320 includes a first leg portion 326 and a second leg portion 327, and exterior garment 300 includes corresponding first leg portion 306 and second leg portion 307. The inner lining 320 can be connected to the exterior garment 300 at several optional locations. In the embodiment shown in FIGS. 34 and 35, a waistband 321 of the inner lining 320 attaches to the exterior garment 300 at a waistband 301 of the exterior garment 300. By attaching the waistband 321 of the inner lining 320 to the exterior garment 300 at the waistband 301, the exterior garment 300 can be allowed to freely move relative to the inner lining 320.

Inner lining 320 can be attached to the exterior garment 300 by any one of several mechanical attachments, such as by being sewn together. Inner lining 320 can also be provided with pockets 322 to accommodate pockets formed in the exterior garment 300. The inner lining 320 is also provided with an opening portion 323 such that the inner lining 320 can be opened when the pants 30 are opened by way of, for example, button 324 and zipper (not shown).

Inner lining 320 is preferably formed of the same shaping material as the shapewear 123 described above. The inner lining 320 could be formed from several panels of material joined together at seams 325, the panels being designed such that the inner lining 320 conforms to the body of the wearer. As shown in FIG. 35, inner lining 320 is shown as including a first panel 330, a second panel 332, a third panel 334, and a fourth panel 336 joined at seams 325. Additional panels or fewer panels could alternatively be used in the construction of the inner lining 320.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. A garment, comprising:

an exterior garment having a waist portion, a first leg portion, and a second leg portion; and an inner lining attached to the exterior garment at the waist portion, the inner lining comprising:

a first leg portion disposed within the first leg portion of the exterior garment; and a second leg portion disposed within the second leg portion of the exterior garment, wherein the inner lining comprises a shaping material, and wherein the inner lining comprises pockets corresponding to pockets of the exterior garment.

2. The garment of claim 1, wherein the inner lining comprises a plurality of panels connected together so as to conform to a body of a wearer.

3. The garment of claim 1, wherein the exterior garment comprises an opening portion, and wherein the inner lining comprises an opening portion corresponding to the opening portion of the exterior garment.

* * * * *